United States Patent [19]

Lasseter

[11] Patent Number: 4,742,459

[45] Date of Patent: May 3, 1988

[54] METHOD AND APPARATUS FOR DETERMINING HYDRAULIC PROPERTIES OF FORMATIONS SURROUNDING A BOREHOLE

[75] Inventor: Thomas J. Lasseter, Setagaya, Japan

[73] Assignee: Schlumber Technology Corp., New York, N.Y.

[21] Appl. No.: 913,035

[22] Filed: Sep. 29, 1986

[51] Int. Cl.[4] ..... E21B 47/00; E21B 49/00; G06F 15/20

[52] U.S. Cl. ..... 364/422; 73/151; 166/100; 324/353

[58] Field of Search ..... 364/422; 73/151, 152, 73/155; 166/100, 264; 324/353, 367, 374

[56] References Cited

U.S. PATENT DOCUMENTS

| | | | |
|---|---|---|---|
| 2,747,401 | 4/1956 | Doll | 73/151 |
| 3,565,169 | 2/1971 | Bell | 166/100 |
| 3,577,781 | 5/1971 | Lebourg | 73/152 |
| 3,577,783 | 5/1971 | Whitten | 73/152 |
| 3,780,575 | 12/1973 | Urbanosky | 73/152 |
| 3,859,850 | 1/1975 | Whitten et al. | 73/155 |
| 3,859,851 | 1/1975 | Urbanosky | 73/155 |
| 3,952,588 | 4/1976 | Whitten | 73/155 |
| 4,149,409 | 4/1979 | Serata | 73/151 |
| 4,287,946 | 9/1981 | Brieger | 166/100 |
| 4,314,338 | 2/1982 | Suau et al. | 364/422 |
| 4,328,705 | 5/1982 | Gringarten | 73/155 |
| 4,427,944 | 1/1984 | Chandler | 324/353 |
| 4,507,957 | 4/1985 | Montgomery | 73/151 |
| 4,513,612 | 4/1985 | Shalek | 73/155 |
| 4,676,094 | 6/1987 | Bardsley et al. | 166/100 |

OTHER PUBLICATIONS

"Introduction to Linear and Non-Linear Programming", D. G. Luenberger, Addison-Wesley, Section I (Introduction).

"Minimization of Sum of Squares Functions for Models Nonlinear in Parameters", pp. 334–379.

"Interpretation of the Pressure Response of the Repeat Formation Tester", G. Stewart et al., SPE 8362, 1979.

*Primary Examiner*—Jerry Smith
*Assistant Examiner*—Allen MacDonald
*Attorney, Agent, or Firm*—Keith Smith; Peter Lee; Martin Novack

[57] ABSTRACT

A method and apparatus are disclosed for determining hydraulic properties of formations surrounding a borehole. In one embodiment, trial values of hydraulic properties such as vertical and horizontal permeability are selected and used to obtain computed formation pressure responses that are compared to measured pressure responses taken at a source and two observation probe positions. Trial values can then be modified to bring the computed pressure responses closer to the measured ones. An improved technique is also disclosed for obtaining the computed pressure responses.

40 Claims, 13 Drawing Sheets

METHOD AND APPARATUS FOR DETERMINING HYDRAULIC PROPERTIES OF FORMATIONS SURROUNDING A BOREHOLE

DESCRIPTION

FIELD OF THE INVENTION

This invention relates to a method and apparatus of subsurface formation investigation and, more particularly, to a method and apparatus for determination of permeability and other hydraulic properties of formations surrounding an earth borehole.

BACKGROUND OF THE INVENTION

The determination of permeability and other hydraulic properties of formations surrounding a borehole is very useful in gauging the producibility of the formations, and in obtaining an overall understanding of the structure of the formations. For the reservoir engineer, permeability has generally been considered a fundamental reservoir parameter which has ranked in importance with porosity, fluid saturations, and formation pressure in the description of a reservoir. When obtainable, cores provide important data concerning permeability. However, in situ measurements of permeability (that is, accurate measurements) for different types of formation conditions has been difficult to obtain using existing well-logging techniques. An ideal permeability logging device would perhaps provide a continuous log of horizontal and vertical permeabilities, but no practical device has been proposed which would provide this capability.

Existing techniques have been classified into indirect and direct methods of determining permeability. In indirect methods, permeability is determined from empirical correlations which attempt to express permeability in terms of other measured formation parameters, for example, porosity and saturation. A direct measurement technique involves actual measurement of fluid flow, pressure, etc. and determination of permeability from these measurements. See, for example, U.S. Pat. No. 4,427,944 of Chandler, assigned to the same assignee as the present application, which describes a system for obtaining permeability by measuring streaming potentials.

Existing devices, whose primary use has been for sampling formation fluids, have also been used, with some success, in estimating formation permeability. Formation testing devices which can take repeated samples are disclosed, for example, in the U.S. Pat. Nos. 3,780,575 and 3,952,588. Typically, in this type of device, a hydraulic pump provides pressure for the operation of various hydraulic systems in the device. Sample chambers are provided in the tool to take samples of formation fluid by withdrawing hydraulically operated pistons. Pressure transducers are provided to monitor pressure as the fluid is withdrawn, and pressure can be continuously recorded at the surface. So-called pre-test chambers are also typically provided and are operated to permit more reliable flow during the subsequent fluid withdrawal. Filters can also be typically provided to filter sand and other particulate matter, and pistons can be provided to clean the filters, such as when the tool is retracted.

One type of formation testing device includes an elongated body and a setting arm on setting pistons which are used to controllably urge the body of the device against a side of the borehole wall at a selected depth. The side of the device that is urged against the borehole wall includes a packer which surrounds a probe. As the setting arm extends, the probe is inserted against the formation, and the packer then sets the probe in position and forms a seal around the probe, whereupon the fluids can be withdrawn from the formation during pre-test and the actual test.

Existing formation sampling devices have been of limited usefulness in determining formation permeability for a number of reasons. In some instances, attempts have been made to use pressure measurements during fluid withdrawal as an indicator of permeability. If fluid is extracted at a fixed flow rate (independent of permeability), as is typically done, in low permeability formations the pressure drop tends to be too large, and solution gas and/or water vapor forms and can make the results uninterpretable. On the other hand, at high permeabilities, the pressure drop tends to be too small and cannot be accurately measured.

In the U.S. Pat. No. 2,747,401 there is disclosed a method and apparatus for determining hydraulic characteristics, including permeability, fluid pressure, and hydraulic anisotropy, of formations surrounding a borehole. A pressure gradient is obtained in the formations by inserting a probe through the borehole wall. Pressure differences between different points are then used to obtain indications of hydraulic characteristics of the formations. In an embodiment disclosed in the patent, a pair of spaced probes are inserted into the formation, and a pressure gradient is generated by inserting a fluid into the formation at one of the probes (a source probe) at a constant flow rate. The other probe (a measurement probe) is coupled to a pressure responsive device. Pressure is measured at the measurement probe before and after injection of the fluid at the source probe. The permeability of the formation is then obtained using a formula in which permeability is proportional to viscosity times flow rate divided by the change in pressure. The patent points out that the pressure gradient can also be obtained by extracting fluid from the formation and that measurements can be made in more than one direction, for example vertical and horizontal, to obtain indications of both vertical and horizontal hydraulic characteristics.

The type of approach set forth in the U.S. Pat. No. 2,747,401, that is, of establishing a pressure gradient and determining hydraulic characteristics therefrom, is a useful beginning toward obtainment of formation hydraulic characteristics. It can be noted, however, that when measurements are taken over a fixed spacing and over a specific time interval, the extent of the formation that is contributing to the output permeability will be dependent upon the permeability itself (since the permeability is a determining factor in how quickly the pressure pattern spreads out in the formation). Also, the time or times at which pressure measurements are taken is limiting in that longer measurement durations may be more desirable from the standpoint of increasing depth of investigation, but may be less desirable from the standpoint of measured signal strength.

There are a number of approaches which might greatly improve the types and accuracy of determinations of hydraulic characteristics of formations that can be obtained, although they would pose practical difficulties in implementation for a variety of reasons. For example, if a complex model of the formations is assumed, and/or if determinations are to be made at a large number of different times, attempted solutions for hydraulic properties can tend to be overly complex and time consuming, which limits their practicality.

It is among the objects of the present invention to provide improved techniques and apparatus for determining hydraulic parameters of formations with improved accuracy and depth of investigation over a relatively wide range of formation permeabilities. It is also among the objects of the present invention to provide improved techniques and apparatus for determination of formation hydraulic parameters quickly and without undue processing.

SUMMARY OF THE INVENTION

The present invention is directed to a method and apparatus for determining hydraulic properties of formations surrounding a borehole. Hydraulic properties include permeability, hydraulic anisotropy, fluid viscosity and fluid compressibility, and other properties which depend on combinations of the aforementioned, for example diffusivity. As described further hereinbelow, the selection of which property is to be determined, and the number of properties which can be determined, depends upon the numbers and types of measurements made in the borehole and upon operator selections for computation.

In accordance with an embodiment of the method of the invention, a transient pressure change is established in the formations surrounding the borehole. The pressure responses of the formations at two spaced observation probe locations are measured, as a function of time. A trial value of the hydraulic property to be determined is selected. Computed formation pressure responses are derived, as a function of time, using the trial value of the hydraulic property. The error as between the computed formation pressure responses and the measured formation pressure responses is then determined. The trial value of the hydraulic property is then modified as a function of the determined error. The deriving, determining, and modifying steps are then repeated to have the computed formation pressure responses more closely approach the measured formation pressure responses, which reduces the error. The ultimately modified trial value can then be read out as the determined hydraulic property.

In a preferred embodiment of the method of the invention, the deriving of a computed formation pressure response includes: representing the fluid flow from the formations during the established pressure change as a series of fluid flow pulses, the durations of said pulses decreasing for later-occurring pulses; and determining the computed formation pressure response at a particular time as a summation of responses to individual ones of said fluid flow pulses. Applicant has found that the speed of the computation process can be improved while maintaining good accuracy by appropriate selection of the time intervals associated with the pulses of fluid flow which are considered to make up the overall flow at the source probe. In particular, the pressure response at a particular probe, i.e. the change in pressure resulting from an instantaneous impulse of flow at the source probe, is strongly time dependent, and falls off inversely with time. In general, this means that the last-occurring portion of the input flow will have the greatest effect on the pressure behavior at a probe. A summation used for obtaining computed pressure response provides a more accurate representation of the theoretical model if the individual flow pulses contribute approximately equally to the summation. Accordingly, the earlier-occurring pulse intervals are selected to have longer durations, with the pulses having successively shorter intervals for later-occurring pulses.

In accordance with a form of the invention, there is provided an apparatus for determining the vertical and horizontal permeability of formations surrounding a borehole. In accordance with an embodiment of this form of the invention, a logging device is moveable through the borehole, the logging device including a source probe, a horizontal observation probe, and a vertical observation probe, the source and observation probes being adapted for contact with the borehole wall. As used herein, the term horizontal observation probe means an observation probe that has a component of azimuthal displacement on the borehole wall with respect to the source probe position, and a vertical observation probe means an observation probe that has a component of vertical displacement on the borehole wall with respect to the source probe position. Means are provided for withdrawing fluid from the formations at the source probe at a pressure which is maintained substantially constant during most of the withdrawal time. Means are provided for measuring formation pressure response at the source probe and the observation probes as a function of time. Means are provided for selecting trial values of the vertical and horizontal permeability of the formations. Means are provided for deriving a computed formation pressure response, as a function of time, at the source probe and the observation probes using the trial values of vertical and horizontal permeability. Means are also provided for determining the error between the computed formation pressure response at the source probe and the observation probes and the measured formation pressure response at the source probe and the observation probes. Further means are provided for modifying the trial values of vertical and horizontal permeability, as a function of the determined error. Also, means are provided for controlling repetitive operation of the deriving means, the determining means and the modifying means to have the computed formation pressure responses at said source probe and observation probes more closely approach the measured formation pressure responses at said source probe and observation probes. The trial values which results in the minimum error are then read out.

In an embodiment of the invention, means are provided for measuring the rate of fluid flow at the source probe, and the means for deriving a computed formation response is responsive, inter alia, to the measured rate of fluid flow.

In a form of the embodiment of the apparatus as set forth, the means for determining the error is operative to combine the errors between the computed and measured formation pressures at the source probe and the observation probes. In this embodiment, the means for modifying the trial values is operative to modify the trial values in a manner which tends to minimize the error.

Hydraulic parameters determined in accordance with the invention can be obtained for a series of depth levels so that an output recording of, for example, permeability versus depth level, would be available for a series of depth levels.

Further features and advantages of the invention will become more readily apparent from the following detailed description when taken in conjunction with the accompanying drawings.

DESCRIPTION OF THE PREFERRED EMBODIMENT

Figure 1:
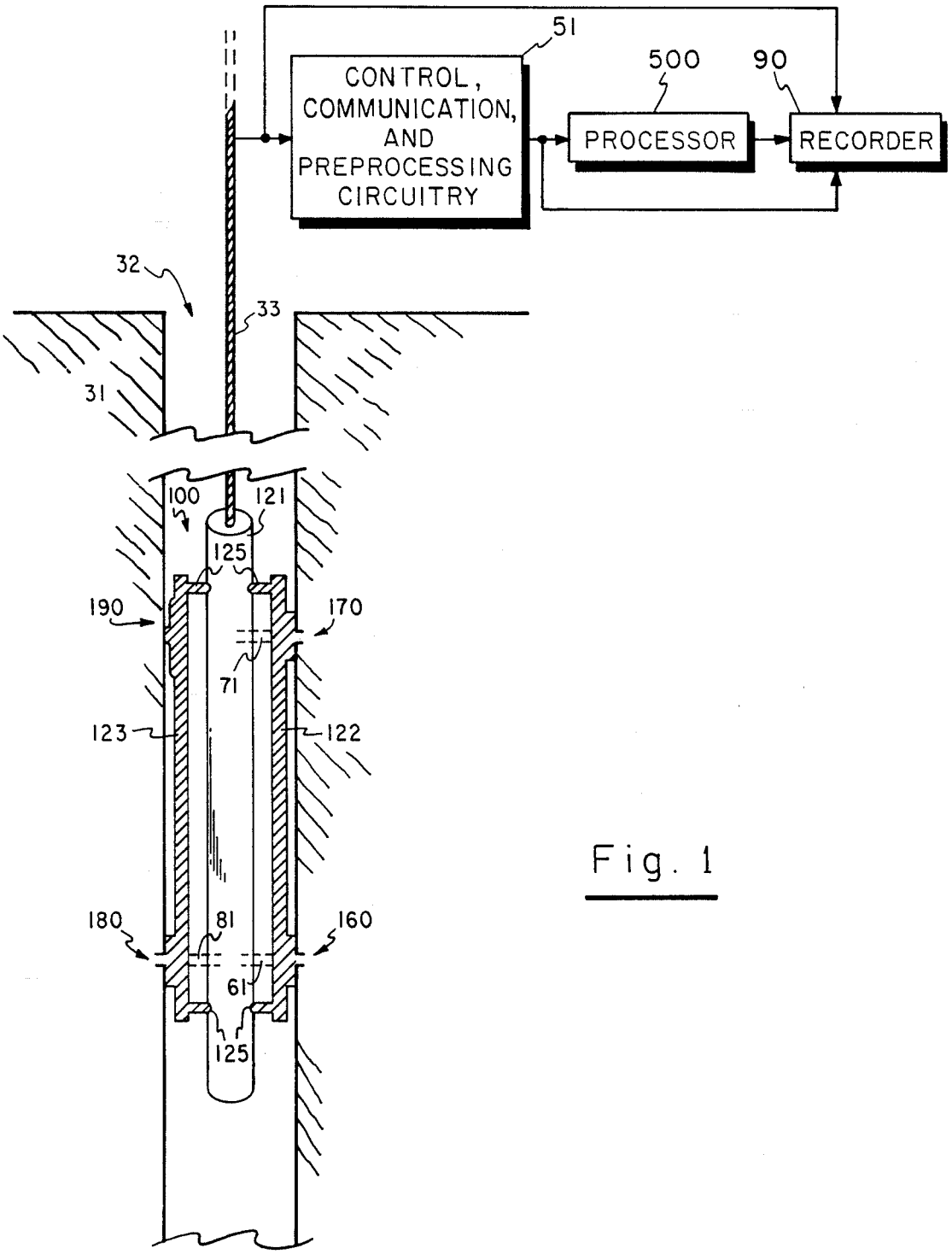
FIG.1 is a diagram, partially in schematic form, of an apparatus in accordance with an embodiment of the invention, and which can be used to practice an embodiment of the method of the invention.

Referring to FIG. 1, there is shown a representative embodiment of an apparatus in accordance with the present invention for investigating subsurface formations 31 traversed by a borehole 32. The borehole 32 is typically filled with a drilling fluid or mud which contains finely divided solids in suspension. The investigating apparatus or logging device 100 is suspended in the borehole 32 on an armored multiconductor cable 33, the length of which substantially determines the depth of the device 100. Known depth gauge apparatus (not shown) is provided to measure cable displacement over a sheave wheel (not shown) and thus depth of the logging device 100 in the borehole 32. The cable length is controlled by suitable means at the surface such as a drum and winch mechanism (not shown). Circuitry 51, shown at the surface although portions thereof may typically be downhole, represents control, communication and preprocessing circuitry for the logging apparatus. This circuitry may be of known type and is not, per se, a novel feature of the present invention.

In an embodiment hereof, the logging device or tool 100 has an elongated body 121 which encloses the downhole portion of the device controls, chambers, measurement means, etc. Arms 122 and 123 are mounted on pistons 125 which extend, under control from the surface, to set the tool. Mounted on the arm 122 are a source probe 160 and, spaced above and vertically therefrom, a vertical observation probe 170. Mounted on the arm 123 is a horizontal observation probe 180. The arm 123 may also contain, such as on the upper portion thereof, a further measuring device, for example an electrical microresistivity device at the position 190, although the present invention does not, per se, involve said further measuring device. Conduits 61, 71, and 81 are provided and are slidably mounted in body 121 for communication between the probes 160, 170 and 180, respectively, and the body 121.

Figure 2:
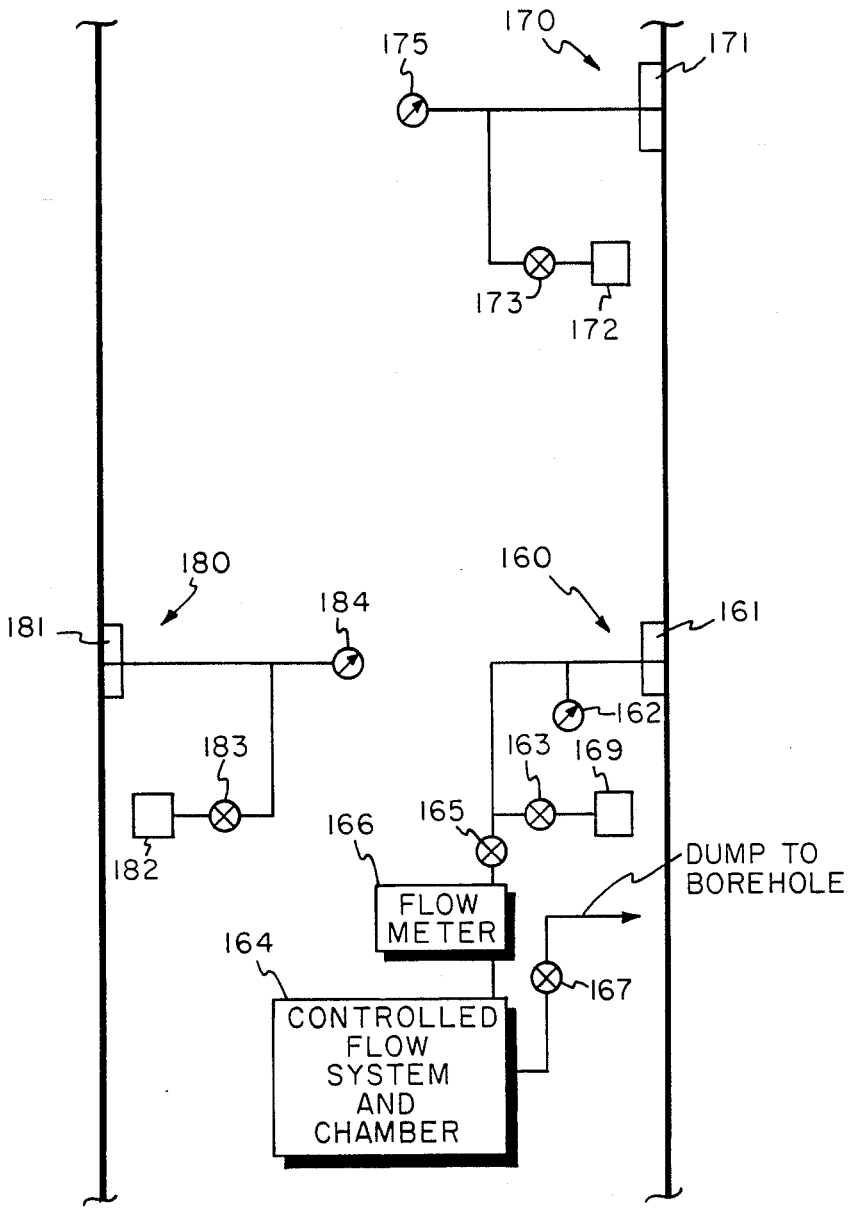
FIG. 2 is a diagram, partially in schematic form, of portions of the logging device of the FIG. 1 embodiment.

In the present embodiment (see FIG. 2) the source probe 160 comprises a fluid sink which includes a packer 161 with a fluid-carrying line that communicates with the formation when the packer is set. The present invention is not dependent on use of a particular type of mechanical means for withdrawing fluid from the formations or taking pressure or flow rate measurements. Devices of the type described in references mentioned herein, set forth in other publications, or which have been otherwise used in the art, can be employed for these purposes. It will be understood that the elements in the diagram of FIG. 2 can be implemented using various types and arrangements of known devices.

A pretest chamber 169 is accessed via a valve 163. A controlled flow system and main chamber 164 is accessible via valve 165 and flow rate meter 166. The control of sample dump to the borehole is via valve 167. A pressure measurement device 162, such as a strain gage type of pressure meter is provided to monitor pressure at the probe.

The vertical observation probe 170 comprises a packer 171 with an observation port or probe that engages the borehole, and communicates with a pretest chamber 172 via a valve 173. A high resolution high-accuracy pressure meter 175, such as of the quartz piezoelectric type, is provided to monitor the pressure at the probe. The horizontal observation probe 180 is of similar construction in the present embodiment, and includes packer 181 with an observation port or probe that engages the borehole, pretest chamber 182 and valve 183, and pressure measuring means 184.

The mechanical elements of the system are controlled from the surface of the earth hydraulically and electrically, in known fashion. The pressure at the source probe and the observation probes and the flow rate of withdrawn fluid at the source probe are monitored and transmitted to the surface of the earth for recording.

The signal outputs of block 51 are illustrated in FIG. 1 as being available to processor 500 which, in the present embodiment, is implemented by a general purpose digital computer, such as a model Microvax II sold by Digital Equipment Corp. It will be understood, however, that a suitable special purpose digital or analog computer could alternatively be employed. Also, it will be recognized that the processor may be at a remote location and receive inputs by transmission of previously recorded signals. The outputs of the computing module 500 are values or value-representative signals for formation hydraulic properties, developed in accordance with techniques described hereinbelow. These signals are recorded as a function of depth on recorder 90, which generically represents graphical, electrical and other conventional storage techniques.

In operation, at a depth level at which measurements are to be taken, the pistons 125 are extended and the tool is set. Under control from the surface, a pretest is then performed at the source probe 160 and the observation probes 170 and 180. The source probe is then activated, by opening valve 165 and initiating the pressure controlled subsystem 164 to withdraw fluid from the formations for a given time or until a particular volume of fluid is withdrawn. In the preferred embodiment hereof, the fluid is withdrawn at a substantially constant pressure for most of the fluid withdrawal time; i.e., when the withdrawal of fluid begins, the pressure at the source probe is reduced to a preselected value below formation pressure, and is then maintained substantially constant during fluid withdrawal. The valve 165 is then closed, at the time designated as shut-in time. During this time, and for a predetermined time after shut-in time (or until a prescribed pressure condition is reached) the pressure at the source probe and at each observation probe is measured by the respective pressure gages and sent to the surface of the earth where the measured pressures are recorded. Typically, although not necessarily, pressure signals are sampled at a period of 0.1 seconds, converted to digital form, and sent to the surface for recording. The flow rate of the fluid being withdrawn is also transmitted to the surface of the earth for recording. Accordingly, there is available at the surface a record of the pressure as a function of time at the source probe and each of the observation probes, and a record of flow rate versus time at the source probe. There are various available devices and techniques for withdrawing fluid from the formations at substantially constant pressure, examples being set forth in U.S. Pat. No. 4,507,957 or 4,513,612.

Figure 3:
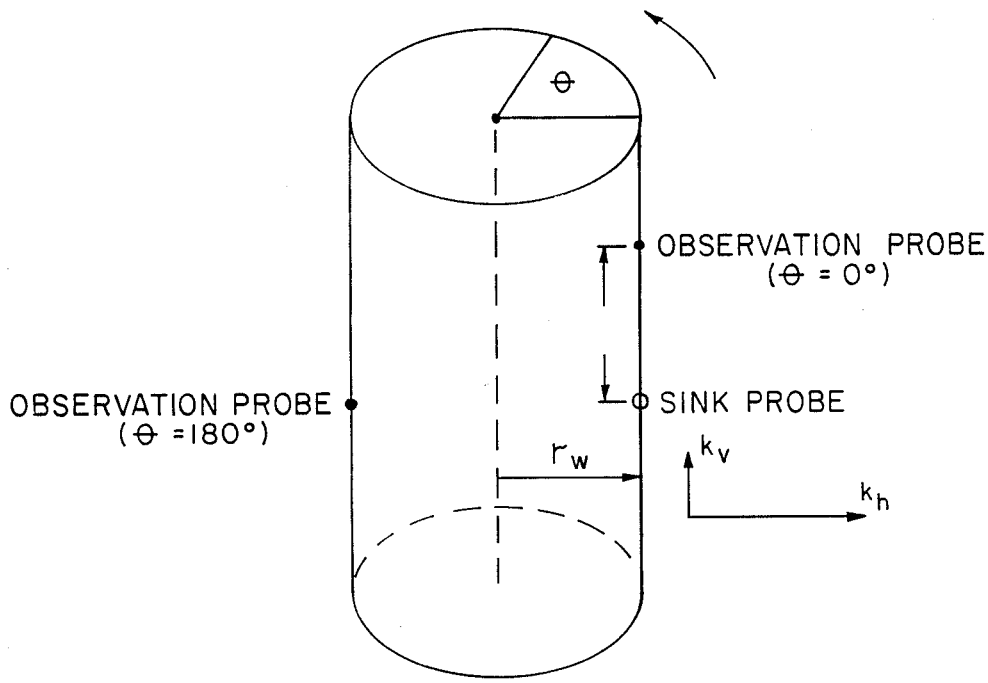
FIG. 3 illustrates a simplified model of the geometry of the borehole at the locations of the source probe and observation probes of the FIG. 1 embodiment.

Some of the underlying theory will next be described. Consider the problem of determining the transient pressure distribution in an infinite anisotropic porous medium bounded internally by an infinite cylinder representing the borehole. In the model used, a continuous point source of strength Q is on the surface of the cylinder, as illustrated in FIG. 3. First, one can compute the response to an instantaneous point-source of strength Q (the Green's function). This solution can then be integrated over the flow time in order to construct the continuous source solution. In the model set forth, the formation and fluid properties are assumed to be constant and homogeneous. The fluid is assumed to be single-phase and slightly compressible. The governing equation is the transient diffusion equation in cylindrical coordinates:

$$\phi c_t \frac{\partial P}{\partial t} = \frac{k_h}{\mu}\left[\frac{1}{r}\frac{\partial}{\partial r}\left(r\partial\frac{P}{\partial r}\right)+\frac{1}{r^2}\frac{\partial P}{\partial \theta^2}\right]+\frac{k_v}{\mu}\frac{\partial^2 P}{\partial z^2} \quad (1)$$

where:

p is the pressure (potential), atm
t time, sec
z vertical distance above sink, cm
r radial distance from borehole centerline, cm
$\theta$ azimuthal angle between sink and observation point
$k_h$ horizontal permeability darcies
$k_v$ vertical permeability darcies
$\phi$ porosity
$\mu$ viscosity, cp
$c_t$ total compressibility, 1/atm The units used are consistent darcy units: darcies, centipoise, atmospheres, centimeters, and seconds. The permeability anisotropy is defined in terms of a vertical and horizontal permeability with the principal directions of permeability aligned with the coordinate directions in a cylindrical coordinate system.

An analytical solution exists for equation (1) and is developed, for example, in H. S. Carslaw and J. C. Jaeger, "Conduction of Heat in Solids", Oxford Science Publications, 1959, and in Y. P. Change and R. C. H. Tsou, "Heat Conduction in an Anistropic Medium Homogeneous in Cylindrical Regions-Unsteady State", Journal of Heat Transfer, February 1977. The general solution includes a specified boundary potential at the cylinder with a mass transfer coefficient across the surface. For the case when the cylinder is a no-flow boundary and the source and observation points are on the surface of the cylinder, the general solution is simplified somewhat and is given by:

$$\Delta P(z,\theta,t) = \frac{Q\mu}{8k_h\eta_v^{\frac{1}{2}}(\pi t)^{3/2}} e^{\frac{-z2}{4\eta_v t}} F(t_{Dh},\theta) \quad (2)$$

where:

Q is the instantaneous source strength, cc
$r_w$ wellbore radius, cm
$\eta_v$ vertical diffusivity, $cm^2/sec$
$F(t_{Dh},\theta)$ flow shape factor
$t_{Dh}$ horizontal dimensionless time The vertical diffusivity $\eta_v$ is given by:

$$\eta_v = \frac{k_v}{\phi\mu c_t} \quad (3)$$

the horizontal dimensionless time is given by:

$$t_{Dh} = \frac{\eta_h t}{r_w^2} \quad (4)$$

The shape factor, which takes account of the borehole, is given by:

$$F(t_{Dh},\theta) = \sum_{n=-\infty}^{\infty} \cos(n\theta) \int_0^{\infty} C_n^2\left(\sqrt{\frac{x}{t_{Dh}}}\right)e^{-x}\,dx \quad (5)$$

where x is a dummy variable of integration and $C_n^2$ is given by:

$$C_n^2(\alpha) = \frac{4}{\pi^2\alpha^{-2}(J_n^1(\alpha)^2 + Y_n^1(\alpha)^2} \quad (6)$$

where J and Y are Bessel functions of the first and second kinds of integer order n.

Figure 4:
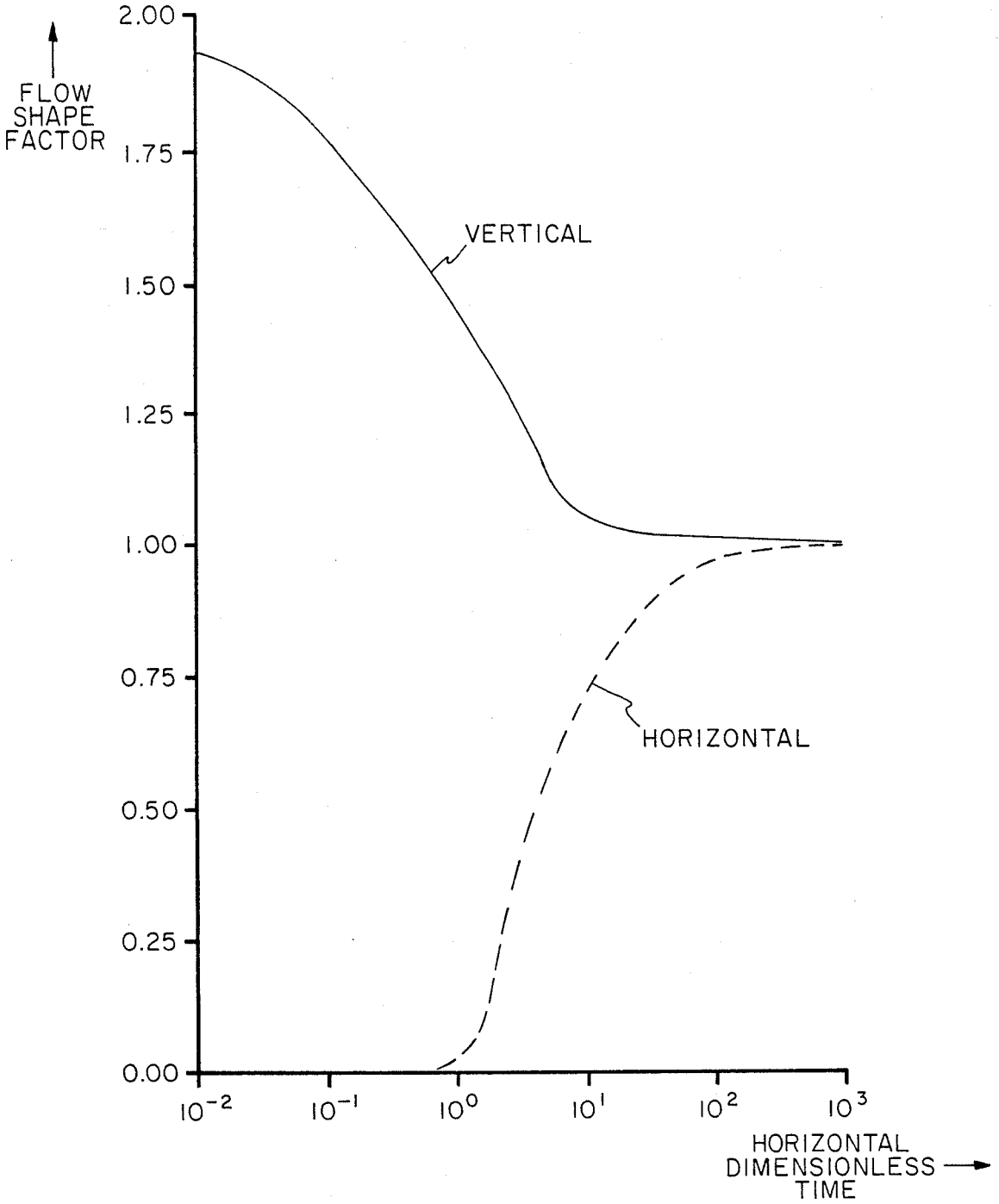
FIG. 4 is a plot of dimensionless shape factor as utilized in an embodiment hereof.

The solution given by equation (2) is equal to the solution with no borehole times the flow shape factor. At early times, the borehole appears as a wall, and the corresponding solution is approximately a point sink in a half-space. For a point vertically above the sink, the response at early time is hemispherical rather than spherical, so the pressure is doubled with respect to the spherical solution, i.e., the flow shape factor at early time is 2.0. At early time for a point located on the opposite side of the borehole, the flow shape factor is 0. At late time, the response approaches spherical, so the shape factor at both vertical and horizontal probes is 1.0. The flow shape factors as a function of horizontal dimensionless time for vertical and horizontal configurations are shown in FIG. 4. The flow shape factor is only a function of the horizontal dimensionless time $t_{Dh}$ and the angle between the sink and observation probes.

Figure 5:
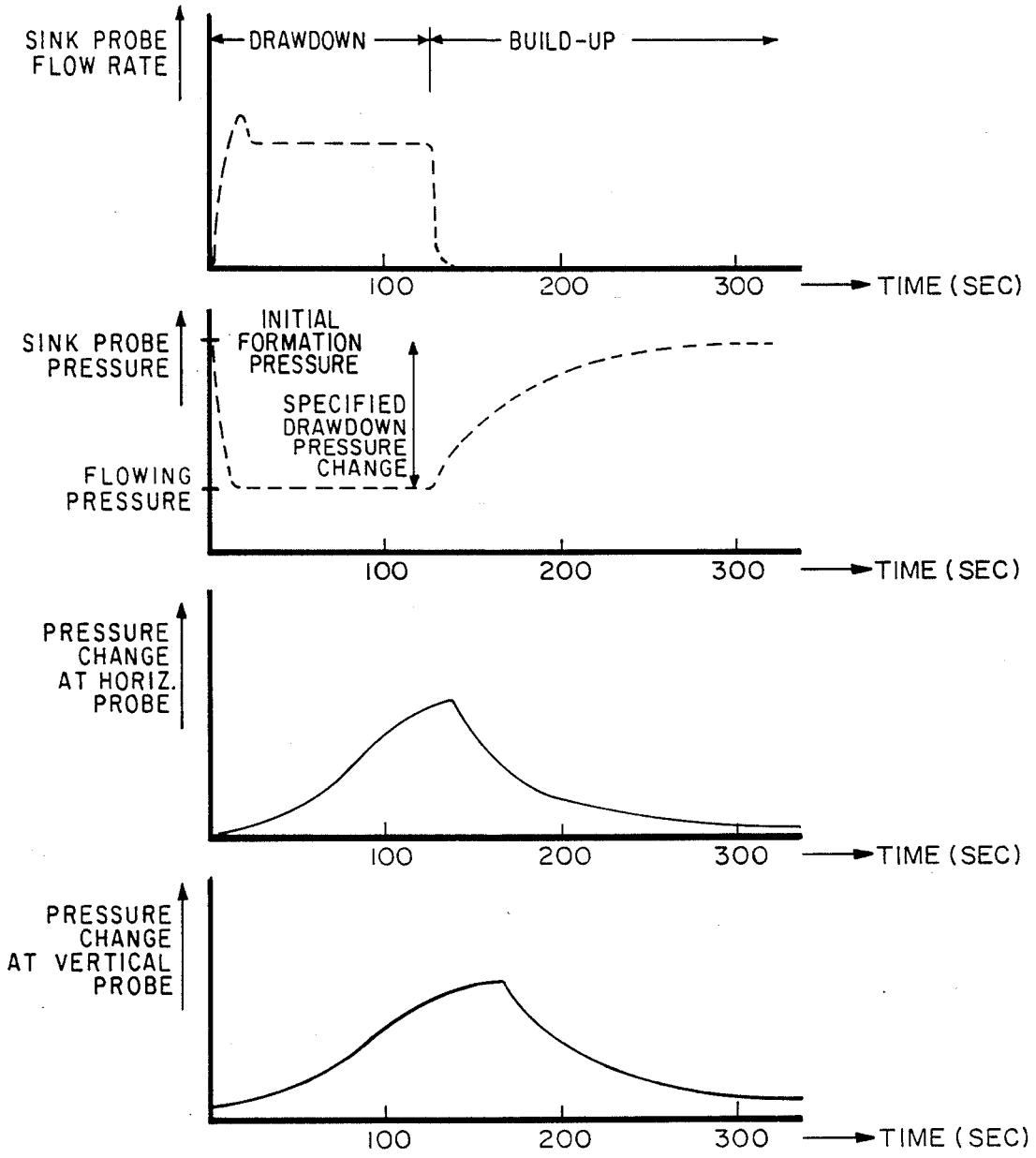
FIG. 5 illustrates an example of flow and pressure behavior at the sink probe and pressure behavior at horizontal and vertical observation probes.

An example of flow rate and pressure at the sink probe and pressure behavior at horizontal and vertical observation probes is shown in FIG. 5. In this example, the probe is located 50 cm vertically from the sink and the medium is isotropic with a permeability of 100 md. The pressure drop at the sink probe is 500 psi. The pressure behavior at the observation probe is designated either "drawdown" or "build-up". In drawdown, the flow at the sink is continuous and the pressure at the probe continues to decline asymptotically to a steady-state. After the end of the flow period, the pressure is said to be in build-up. The pressure will continue to decline until the cessation of flow is felt, and then builds back up to its initial value. The convention that pressure change is positive when fluid is being removed at the sink probe facilitates plotting on a logarithmic scale, although any desired convention can be used.

The solution given by equation (1) is for an instantaneous point-source. In order to compute the pressure response in drawdown or in build-up when the flow time is substantial with respect to the observation time, the instantaneous point-sink solution is integrated numerically over the length of the pulse. The dimensionless flow time for a horizontal configuration is defined as:

$$t_{fDh} = \frac{\eta_h t_f}{r_w^2} \tag{7}$$

and for a vertical configuration:

$$t_{fDv} = \frac{\eta_v t_f}{z^2} \tag{8}$$

With a pulse length of $t_f$ and a flow rate q, the pressure as a function of time t from the end of the pulse is given by:

$$\Delta P(z,\theta,t) = \int_t^{t+t_f} \frac{9\mu}{8k_h\eta_v^{\frac{1}{2}}(\pi\tau)^{3/2}} e^{\frac{-z2}{4\eta_v\tau}} F(\tau, \theta, \eta_h, r_w)d\tau \tag{9}$$

where:

q is the rate at which fluid is removed, cc/sec t time after shut-in, sec $t_f$ flow time, sec $\tau$ variable of integration, sec If the shape factor was constant and could thus be removed from the integral, the integration could be performed. Because the shape factor is a strong function of time, as shown in FIG. 4, the integration is done numerically. To perform the numerical integration of equation (9), the flow time interval is divided into "n" subintervals. The integral is then evaluated as a summation over the "n" subintervals, and pressure is given by:

$$\Delta P(z,\theta,t) = \sum_{i=1}^{n} \frac{Q_i\mu}{8k_h\eta_v^{\frac{1}{2}}(\pi\tau_i)^{3/2}} e^{\frac{-z2}{4\eta_v\tau_i}} F(\tau_i, \theta, \eta_h, r_w) \tag{10}$$

where:

$T_i$ is $(t+t_f-t_i)$ sec t time after shut-in, sec $t_i$ average flow time for interval "n", sec $t_f$ flow time, sec $Q_i$ is $q_i\Delta t$ This numerical approximation is effectively the sum of a series of instantaneous point-sinks located at an average time in each subinterval "i", each with strength $q\Delta T_i$, where $\Delta T_i$ is the width of the interval. Gauss-Laguerre integration can be used to evaluate the shape factor equation (5) as $$\int_o^{\infty} f(x)\, e^{-x}dx = \sum_{i=1}^{M} \omega_i f(x_i) \tag{11}$$

where:

$w_i$ is a tabulated weighting-factor for term "i"

$x_i$ a tabulated argument for the function evaluation

The summation over the order "n" in equation (5) is a minimum of five terms and can be continued until the absolute value of the last term is, for example, smaller than $10^{-6}$ of the sum of terms. Generally no more than 30 terms are necessary. $C_n^2$ as defined by equation (6) can be tabulated so that the flow shape factor for any value of $\theta$ can be computed, and the values for 0° and 180° can be tabulated for use herein.

As indicated, for the numerical evaluation of equation (10), the sink flow time is divided into intervals. This is represented in simplified form in FIG. 6 which shows a rectangular flow pattern of flow rate q from time t=0 to time $t=t_f$. The flow time is divided into time intervals $\Delta t$, each having a source strength $q\Delta t$. In general, increasing the number of intervals increases the accuracy of the numerical approximation of the integration, but increases processing time. As described further hereinbelow, a disclosed technique of interval selection permits attainment of good accuracy without the need for using an unduly large number of intervals. Also, in the preferred form of operation hereunder, the sink will operate at substantially constant pressure, which may not result in constant flow rate. This would mean that the pulse amplitudes will vary during the flow at the source probe.

The method of the present embodiment for obtaining fluid flow parameters of the formations will initially be described in general terms. A pressure drop is established at the source probe 160, and measurements of pressure as a function of time are taken at the horizontal and vertical observation probes 170 and 180, as well as at the source probe 160. These signals are stored in memory, typically in digital form. Initial trial values of hydraulic parameters of the formation are then selected, values of vertical and horizontal permeability being selected in one embodiment. The trial values are then utilized in equation (10) to solve for the change in pressure, at each probe position, as a function of time. The difference between the measured pressure values and the computed pressure values obtained using the trial parameters is used to obtain the error associated with the trial parameters. The error is utilized in determining the manner in which the trial parameters are to be modified. After such modification, new computed pressure values are obtained, and the procedure is continued until there is convergence toward a solution, or until the error is within an acceptable range.

Figure 7:
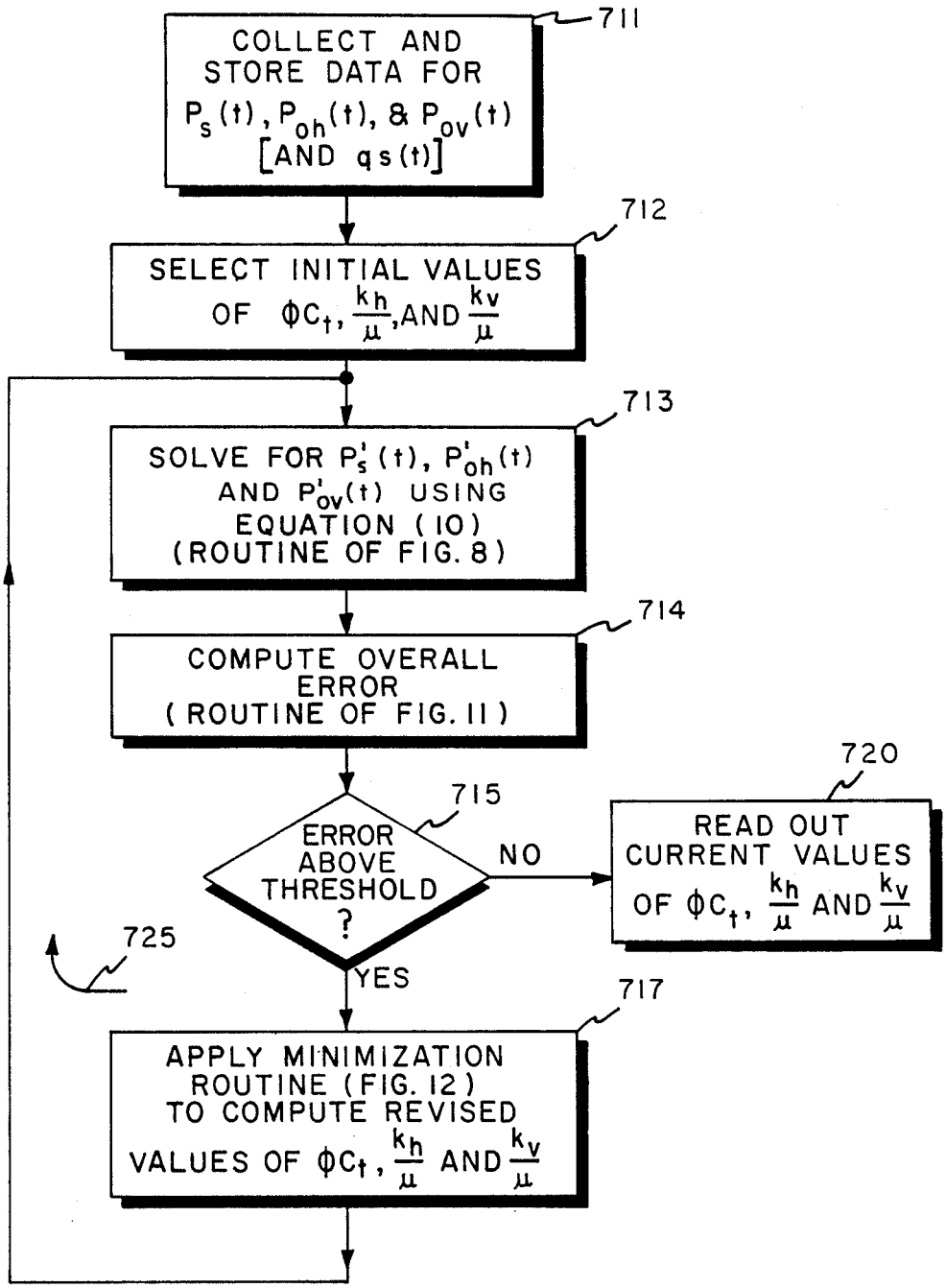
FIG. 7 is a flow diagram of a routine for programming the process in accordance with an embodiment of the invention.

Referring to FIG. 7, there is shown a flow diagram of the routine for programming the processor 500 in accordance with an embodiment of the invention. The block 711 is a general representation of the collection and storage of the pressure versus time data at the source probe, the horizontal observation probe, and the vertical observation probe, designated $P_s(t)$, $P_{oh}(t)$ and $P_{ov}(t)$, respectively. These values, which may be collected and stored under control of the processor, or by other means, as well as other data which includes flow rate as a function of time, $q_s(t)$, can be manually or automatically obtained under operator control, as previously described. The block 712 is entered, this block representing the selection of initial values of hydraulic parameters. In the present embodiment, the hydraulic parameters to be obtained relate to the vertical and horizontal permeability of the formations. In particular, initial values are selected of $k_h/\mu$, $k_v/\mu$, and $\phi c_t$, where $k_h$ and $k_v$ are respectively the horizontal and vertical permeability of the formations, $\mu$ is the viscosity of the formation fluid, $\phi$ is the porosity of the formations, and $c_t$ is the compressibility of the formation fluid. As previously noted, diffusivity is defined as:

$$\eta = \frac{k}{\phi \mu c_t}$$

So the vertical and horizontal diffusivities are respectively defined as:

$$\eta_v = \frac{k_v}{\phi \mu c_t}$$

$$\eta_h = \frac{k_h}{\phi \mu c_t}$$

It is seen that if the three quantities indicated above, and in block 712, are determinative of the horizontal and vertical diffusivities of equation (10). As used herein, references to determination of hydraulic parameters such as permeability or diffusivity also means obtainment of quantities which are proportional to or otherwise a function of these parameters. It will be understood that there is a choice of which parameters are to be determined and the form thereof. Initial values of the variables can be selected arbitrarily or, more preferably, from past experience. Measurement values from the present logging device or other logging devices can, of course, be used to advantage. For example, for the illustrated set of variables in the present embodiment, porosity may be available from other logging devices, and initial fluid viscosity and compressibility values may be estimated from prior experience. The initial values for vertical and horizontal permeability may be estimated using techniques described in the aboverefereenced prior art pertaining to repeat formation testers or, for example, known techniques for estimating permeability using pressure and/or flow rate measurements from a single probe (e.g. the source probe in this case).

Figure 8A:
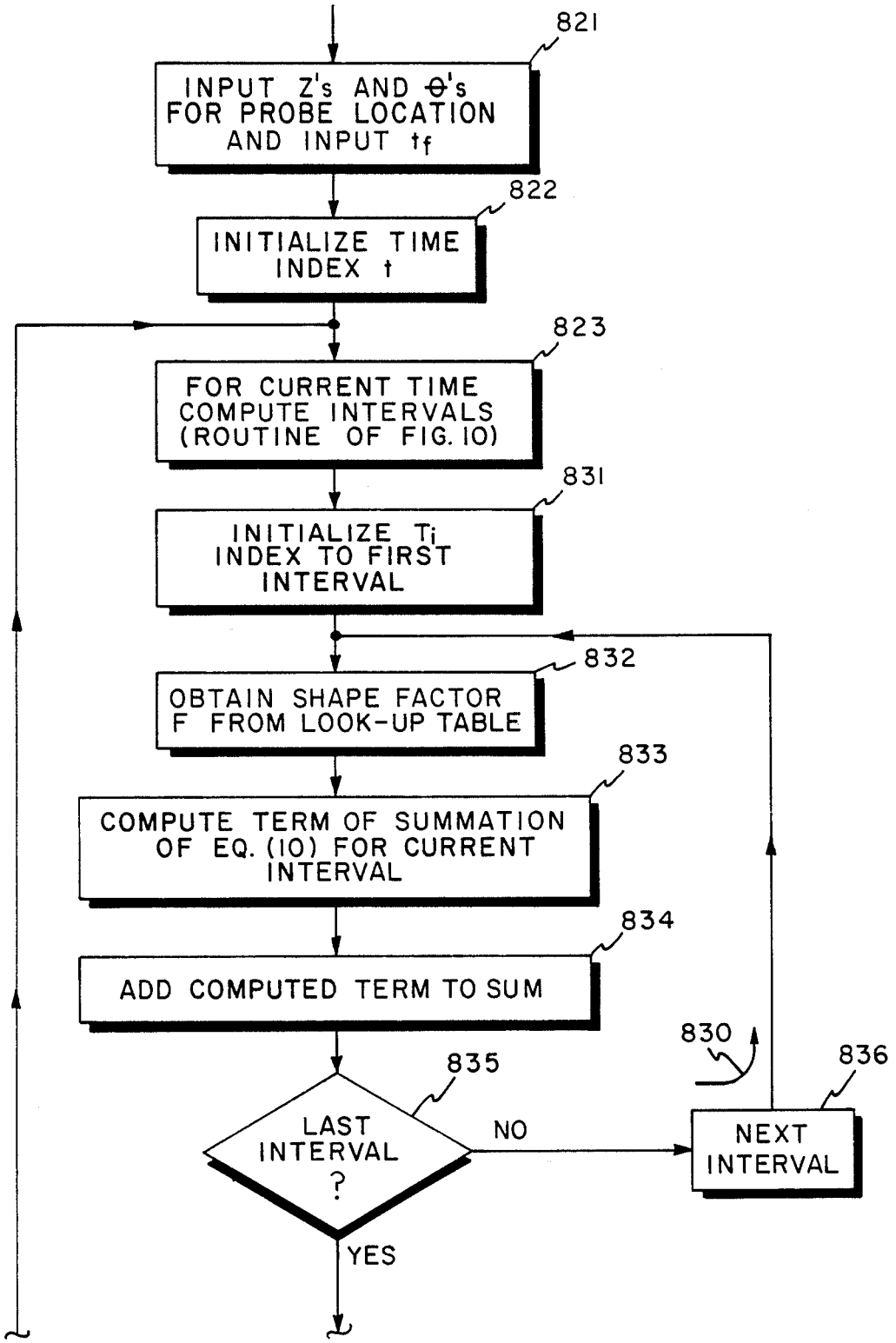
FIGS. 8A and 8B, when placed one-below-another, show a flow diagram of a routine for obtaining computed pressures in accordance with an embodiment of the invention.
Figure 8B:
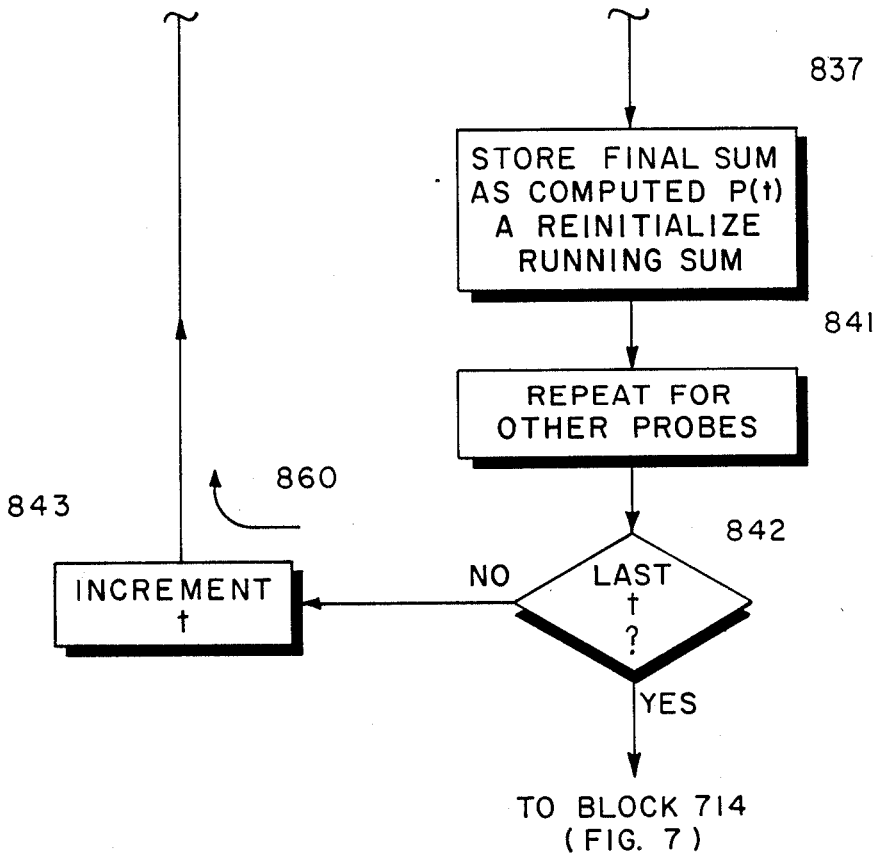

The block 713 is then entered, this block representing the routine, as set forth in FIG. 8, for obtaining the computed values of pressure as a function of time at the source probe, horizontal observation probe, and vertical observation probe, designated $P_s'(t)$, $P_{oh}'(t)$ and $P_{ov}'(t)$, respectively. The block 714 is then entered, this block representing the computation of the error as between the measured and computed values of pressure as a function of time at the probes. This routine is described hereinbelow in conjunction with the flow diagram of FIG. 11. Briefly, the error is measured by a summation of the squares of the differences between the measured and computed values at the times at which said values are measured and/or computed. Once the error has been obtained, inquiry is made (diamond 715) as to whether or not the error is above a predetermined threshold. If so, the block 717 is entered. This block represents a minimization routine which is described in conjunction with FIG. 12. The minimization routine is utilized to compute revised values of the selected parameters ($\phi c_T$, $k_h/\mu$ and $k_v/\mu$, in this case) in accordance with a procedure which tends to minimize the error. The block 713 is then entered, and the values of the pressure at the probes, as a function of time, are recomputed using the revised values of the selected parameters. The loop 725 then continues until the error is suitably minimized, whereupon the block 720 is entered and the latest values of the selected parameters are read out and recorded as the obtained parameters for the particular depth level at which the measurements were taken. Alternatively, if the error threshold condition is not reached within a certain number of passes, the values obtained can be read out at that point. Also, it will be understood that the computed error can be recorded in conjunction with the computed parameters at the particular depth level of measurement.

Referring to FIG. 8, there is shown a flow diagram of the routine for obtaining the computed pressure values, as a function of time, for each probe and using the selected or modified parameter values. The block 821 represents the inputting of the values of z and $\theta$ for the probe locations. In the present embodiment, the source probe is located at $z=0$, $\theta=0°$, the horizontal observation probe is located at $z=0$, $\theta=180°$, and the vertical observation probe is located at $z=z_l$ and $\theta=0°$, where $z_l$ is the spacing between the source probe and the vertical observation probe. As noted above, a horizontal observation probe means an observation probe that has a component of azimuthal displacement on the borehole wall with respect to the source probe position, and a vertical observation probe means an observation probe that has a component of vertical displacement on the borehole wall with respect to the source probe position. Accordingly, it will be understood that other probe positions can be utilized. The block 822 is then entered, this block representing the initialization of a time index t. The subsequent incrementing of the time index will determine the times between the successive pressure calculations. These can be selected to be equal to the sampling period at which the measurements were recorded or a different sampling period, as desired. The block 823 is then entered, this block representing the computation, for the current time, of the pulse intervals (see FIGS. 9 and 10) that will be used in performing the summations to obtain the computed pressure at each probe for the current time t. This routine is described in conjunction with the flow diagram of FIG. 10.

The next portion of the routine relates to the computation of the summation represented by equation (10) to obtain P(t) for each probe location. The block 831 represents the initialization of the $T_i$ index to the first time interval (to be used in obtaining the summation of equation (10)). The block 832 is then entered, this block representing the obtainment of the shape factor F from a look-up table. As described hereinabove in conjunction with FIG. 4, the shape factor for a given set of conditions can be computed and stored, as a function of dimensionless time. Accordingly, for example, the values as shown in FIG. 4 can be stored in a look-up table and, for a particular time, the table can be used to obtain the appropriate value of F for the probe location in question. A term of the summation of equation (10) can then be computed for the current interval, as represented by the block 833. It will be understood that whereas the interval size is obtained using the approximations as set forth in conjunction with the description below of FIGS. 9 and 10, the amplitude of the impulse can be the measured flow rate at the time of occurrence of the interval, $T_i$. The computed term is next added to a running sum, as represented by the block 834. Inquiry is then made (diamond 835) as to whether or not the last interval has been processed. If not, the block 836 is entered, the $T_i$ interval index is incremented, and the next term of the sum is obtained and added in the manner just described. The loop 830 then continues until the last interval has been processed, whereupon the sum will be the summation of equation (10). The summation is stored as the computed change in pressure for the current time, and the running sum is reset as represented by the block 837.

As noted above, the pressure at the current time can be stored as a change in pressure or as the computed pressure with respect to an original pressure. The computation is then repeated for the other probe locations. For example, if the pressure at the current time had been first computed for the vertical observation probe, the procedure is then repeated to obtain the pressure at the horizontal observation probe and the source probe at the current time, as represented by the block 841. It will be understood that factors such as the shape factor and geometrical elements pertaining to the probe location will be different in equation (10) for these subsequent computations. However, it may be more convenient to perform interval selection or use in a different order than is set forth in the illustrative flow diagram of FIG. 8, and such variations can be utilized, as desired, for a particular routine of operation. A determination is next made (diamond 842) as to whether or not the last time t, at which the pressure response is to be computed, has been reached. If not, t is incremented (block 843), and the block 823 is reentered. The loop 860 then continues until all the desired times have been processed.

In accordance with a feature hereof, the fluid flow at the source probe which ultimately contributes to pressure changes at the observation probes (as well as at the source probe) is separated into pulses of flow in order to compute summations of the effect on pressure in accordance with relationship (10), and thereby facilitate derivation of formation properties. Applicant has found that the speed of the computation process can be improved while maintaining good accuracy by appropriate selection of the time intervals associated with the "impulses" of fluid flow which are considered to make up the overall flow at the source probe. In particular, the pressure response at a particular probe, i.e. the change in pressure resulting from an instantaneous impulse of flow at the source probe, is strongly time dependent, and falls off inversely with time. In general, this means that the last-occurring portion of the input flow will have the greatest effect on the subsequent pressure behavior at a probe. The summation of equation (10) will tend to be a more accurate representation of the integral in equation (9) if the individual flow pulses contribute approximately equally to the summation. Accordingly, the earlier-occurring pulse intervals are selected to have longer durations, with the pulses having successively shorter intervals for later-occurring pulses.

Figure 6:
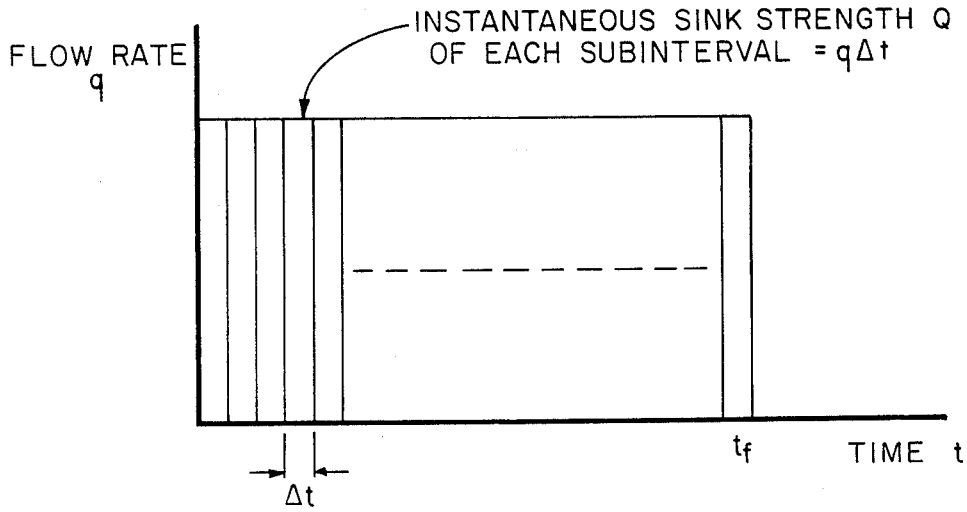
FIG. 6 is a simplified diagram of a fluid flow pattern, as divided into a series of fluid flow pulses.
Figure 9:
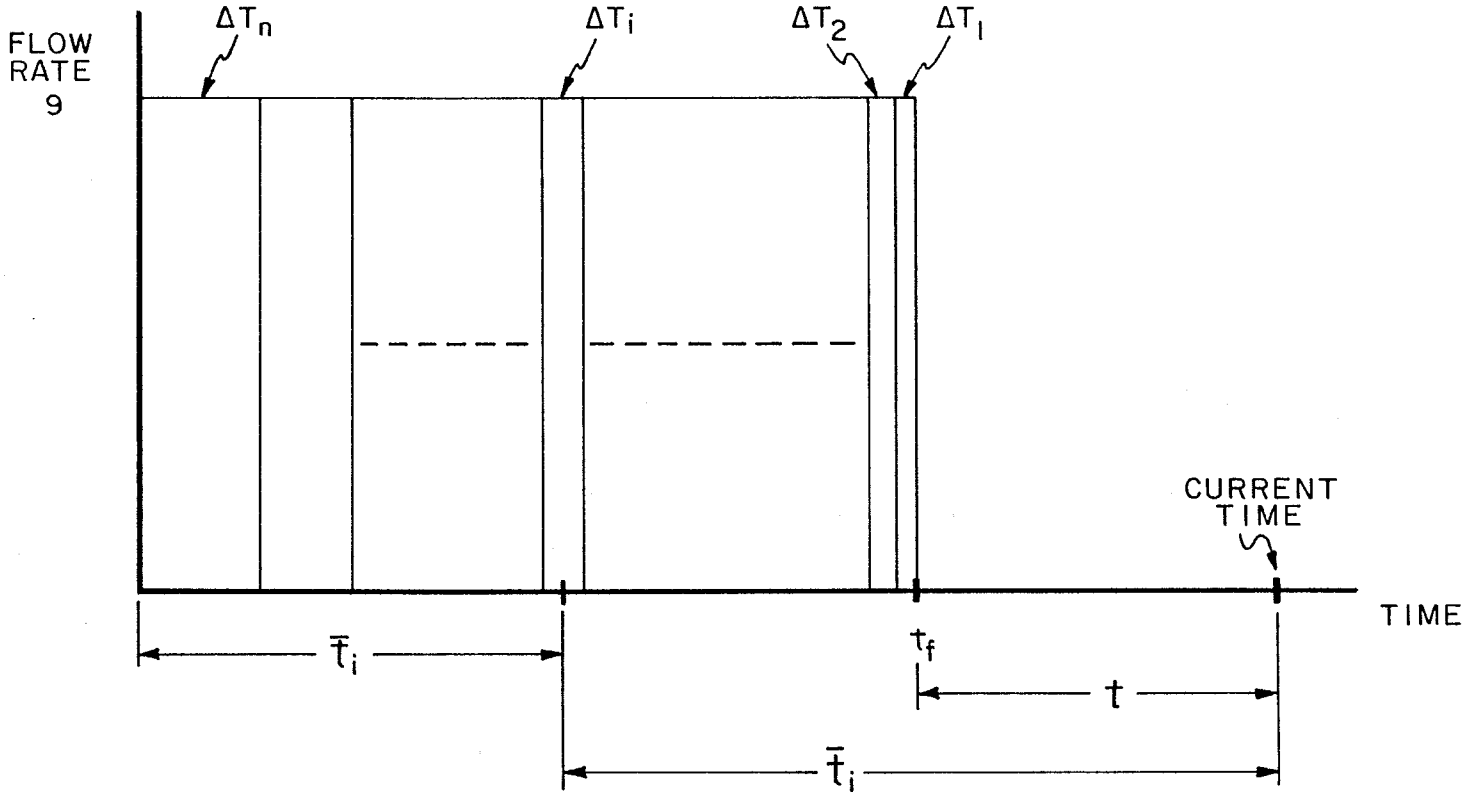
FIG. 9 illustrates the manner in which pulse intervals are obtained in accordance with an embodiment of the invention.

The diagram of FIG. 9 shows the sink flow at source probe 160, previously represented in simplified form in FIG. 6, as being divided into a series of gradually smaller interval pulses of duration $\Delta T_i$. As defined above, $t_f$ is the flow time, t is the time since shut-in, $\bar{t}_i$ is the average flow time for interval i (that is the time from the beginning of flow to the center of interval i), and $\overline{T}_i$ is $t+t_f-\bar{t}_i$ (that is the time from the center of interval $\Delta T_i$ to the present time being considered. To facilitate understanding of the technique for interval selection, the flow rate is shown as being constant with time until shut-in time ($t_f$) when the flow rate goes to zero. Actual operation at substantially constant pressure will generally not involve a constant flow rate. As will become understood, the technique hereof is applicable to a varying flow, and the amplitude of each pulse can be taken into account when obtaining $q\Delta T_i$.

Assume that there are n intervals and that the intervals from right to left (i.e., from last-occurring to first-occurring) are designated as $\Delta T_1, \Delta T_2, \ldots \Delta T_n$. In the present embodiment, the intervals are selected such that each interval $\Delta T_i$ is related to the size of the adjacent succeeding interval, $\Delta T_{i-1}$, in accordance with the relationship $$\Delta T_i = G\Delta T_{i-1} \tag{12}$$

where G is a multiplying factor that is greater than 1. Using this relationship, it is seen that the first-occurring interval, $\Delta T_n$ is related to the last-occurring interval, $\Delta T_1$, in accordance with the relationship $$\Delta T_n = G^{n-1}\Delta T_1 \tag{13}$$

In the present embodiment the relationship between intervals is selected to approximate a situation where $$\frac{\Delta T_n}{\Delta T_1} = \frac{T_n}{T_1} \approx \frac{t+t_f}{t} \tag{14}$$

that is, where the ratio of the sizes of the first and last intervals are proportional to the ratio of the elapsed times between the respective intervals and the current time. From equation (13) we have $$\frac{\Delta T_n}{\Delta T_1} = G^{n-1} \tag{15}$$

Substituting (15) into (14) gives $$G^{n-1} = \frac{t+t_f}{t} \tag{16}$$

so that $$G = \left(\frac{t+t_f}{t}\right)^{1/(n-1)} \tag{17}$$

The sum of the individual time intervals is $t_f$, so we have $$t_f = \Delta T_1 + \Delta T_2 + \Delta T_3 + \ldots \Delta T_n$$
$$= \Delta T_1 + \Delta T_1 G + \Delta T_1 G^2 + \ldots \Delta T_1 G^{n-1}$$
$$= \Delta T_1 (1 + G + G^2 + \ldots G^{n-1})$$

Solving for $\Delta T_1$ gives $$\Delta T_1 = \frac{t_f}{1 + G + G^2 + \ldots G^{n-1}} \quad (19)$$

Accordingly, equations (17), (19) and (13) can be utilized to solve for the durations of all intervals. The average time $\overline{T}_i$ for an interval $\Delta T_i$ equals t plus the sum of the durations of the previous intervals and one-half the duration of $\Delta T_i$; so $$T_i = t + \sum_{j=1}^{i-1} \Delta T_j + \tfrac{1}{2}\Delta T_i \quad (20)$$

It is seen from equation (14) that when t is very small (just after shut-in), G can become large. Accordingly, in the present embodiment, when G exceeds a preselected GMAX, G is set equal to GMAX before intervals are computed.

Figure 10A:
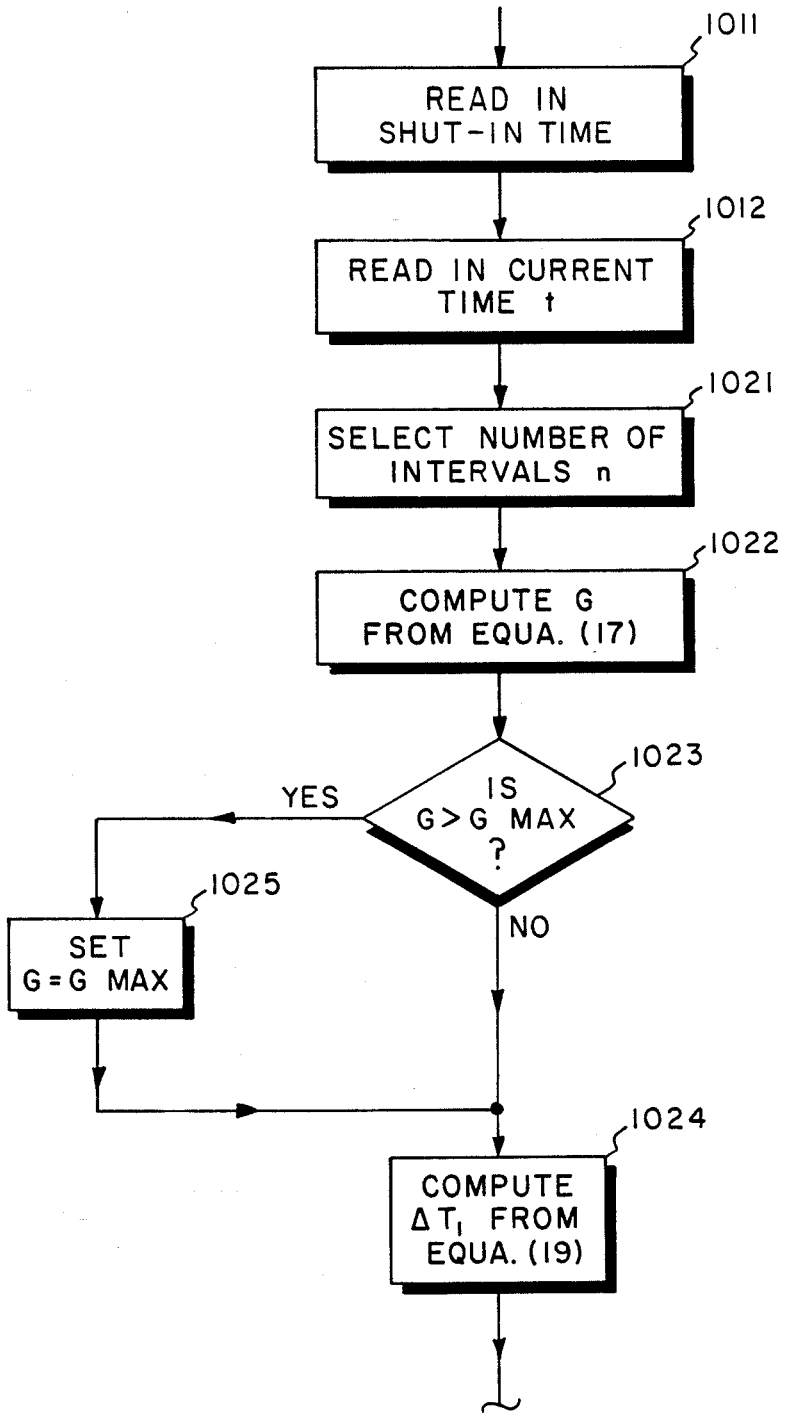
FIGS. 10A and 10B, when placed one-below-another, show a flow diagram of the routine for obtaining the fluid flow pulse intervals and locations in accordance with an embodiment of the invention.
Figure 10B:
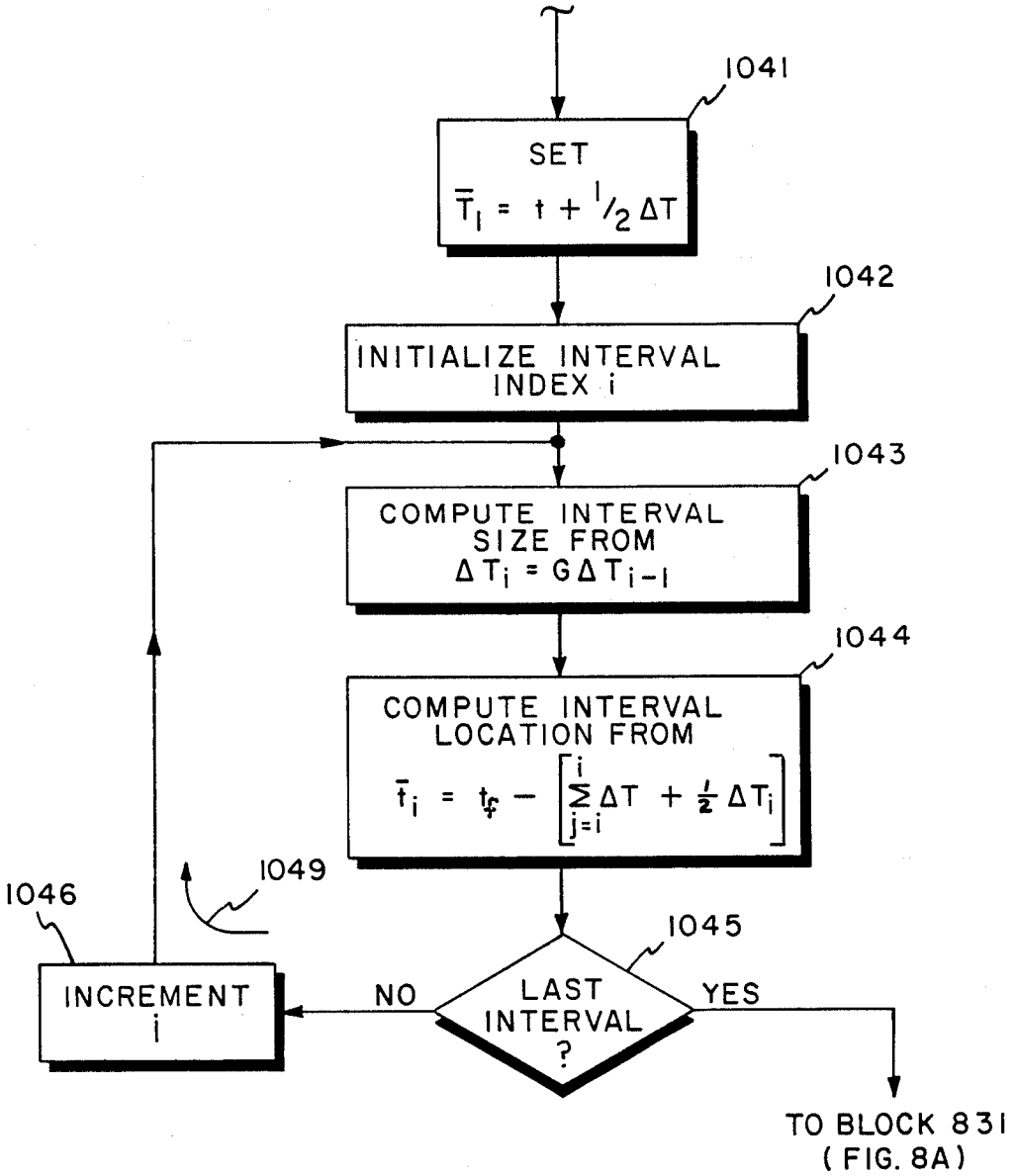

Referring to FIG. 10, there is shown a flow diagram of the routine represented by block 823 of FIG. 8 in accordance with an embodiment of the invention for programming the processor 500 to implement the determination of intervals for use in the summations pursuant to the loop 830 of the FIG. 8 flow diagram. The shut-in time, $t_f$, and the current time, t, are read in, as represented by the blocks 1011 and 1012. The number of intervals to be used, n, is then selected, as represented by the block 1021. The value of n can be a default value, for example 100, or can be selected by the operator, it being understood that a smaller value of n will speed processing time for a particular summation, but may result in the summation providing a less accurate representation of the integral being approximated.

The block 1022 is then entered, this block representing the computation of the multiplying factor, G, in accordance with relationship (17), as described above. Inquiry is then made (decision diamond 1023) as to whether or not G is greater than a predetermined maximum value of G, designated as GMAX. As described above, a value of G that is too large will result in overly large gradations of interval sizes over the flow time. GMAX can be predetermined, or selected by the operator during operation. If G is not greater than GMAX, then block 1024 is entered directly, this block representing the computation of the first interval, $\Delta T_1$ from expression (19) above. If G is greater than GMAX, then the block 1025 is entered, this block representing the setting of G equal to GMAX. The block 1024 is then entered for computation of the initial interval, $\Delta T_1$ in accordance with relationship (19).

In the next portion of the routine, the location and size of all of the intervals, $\Delta T_i$ are obtained, starting with the already-determined interval size for the first interval, $\Delta T_1$. The time $\overline{T}_1$ associated with the first interval $\Delta T_1$ is set to $t+(\frac{1}{2})\Delta T_1$ (block 1041), and the interval index, i, used for determining the size and location of the remaining intervals, is initialized at 2 (block 1042). The size of the next interval is then determined, using relationship (12), as represented by the block 1043. The time $\overline{T}_i$ for interval i is next determined (block 1044) using equation (20). The interval index is then tested to see if the last interval has been reached (diamond 1045). If not, the index i is incremented (block 1046), and the loop 1049 continues until all intervals have been determined.

In the present embodiment, the error at a particular probe position is taken to be the sum of the squares of the difference between the measured and computed pressures over a time period of interest. For example, the error at the vertical observation probe is $$E_{ov} = \sum_{t=t_o}^{t_m} [P_{ov}(t) - P'_{ov}(t)]^2 \quad (22)$$

where the time to $t_m$ is the time period of interest [which may be, for example, from 1 to 100 seconds at intervals of 1 second] and the values of t are those at which pressure measurements were sampled and computed. The total error, E, is $$E = E_s + E_{ov} + E_{oh} \quad (23)$$

$$E = \sum_{t=t_o}^{t_m} [P_s(t) - P'_s(t)]^2 + \sum_{t=t_o}^{t_m} [P_{ov}(t) - P'_{ov}(t)]^2 + \sum_{t=t_o}^{t_m} [P_{oh}(t) - P'_{oh}(t)]^2 \quad (24)$$

Figure 11:
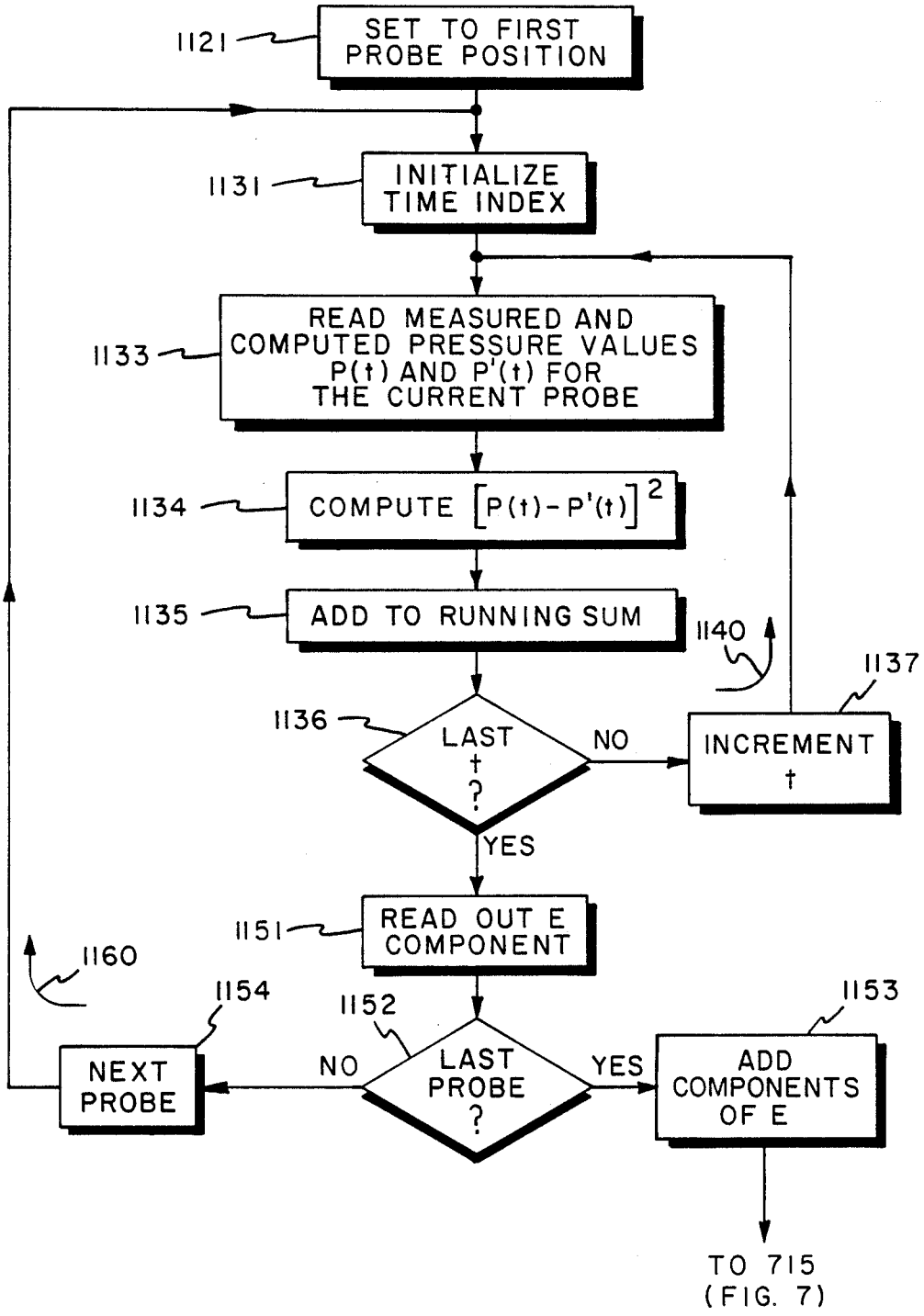
FIG. 11 is a flow diagram of the routine for obtaining the error.

FIG. 11 shows an embodiment of the routine for obtaining the error. The block 1121 represents the selection of the first probe position (source probe, vertical observation probe, or horizontal observation probe) at which a component of the error signal is to be obtained. A time index is initialized (block 1131). The measured and computed values of P(t) and P'(t) for the probe position currently being considered are obtained from memory, as represented by the block 1133. The quantity $[P(t)-P'(t)]^2$ is then computed (block 1134) for time t. The computed quantity is added to a running sum (which was previously initialized at zero), as represented by the block 1135. Inquiry is then made (diamond 1136) as to whether or not the last t has been considered. If not, t is incremented (block 1137), the block 1133 is reentered, and the loop 1140 continues until all terms of the summation of relationship (22) have been obtained. The block 1151 is then entered, this block representing the storage of the just-computed E component, and the reinitializing of the running sum. Inquiry is then made (diamond 1152) as to whether or not the error component signals have been obtained for all probes. If not, the next probe is considered (block 1154), and the loop 1160 is continued until the error components for all probes have been obtained. These components are then added to get the overall error, consistent with relationships (23) and (24).

There are a number of well-known techniques for minimizing an error function which is a function of multiple variables, and the present invention is not dependent upon use of any particular technique for modifying variables to efficiently reduce an error function. For a general reference can be made to Luenberger, "Introduction to Linear and Nonlinear Programming", Addison Wesley Publishing. One technique which is appropriate is to compute the gradient of the error function, and then to change the variable values in a direction defined by the gradient, and with a step size that is determined, for example, from past experience, or from trying different step sizes during the process to determine optimum step sizes. This technique of using the gradient of the error function may be of the type described in U.S. Pat. No. 4,314,338, assigned to the same assignee as the present application.

Figure 12:
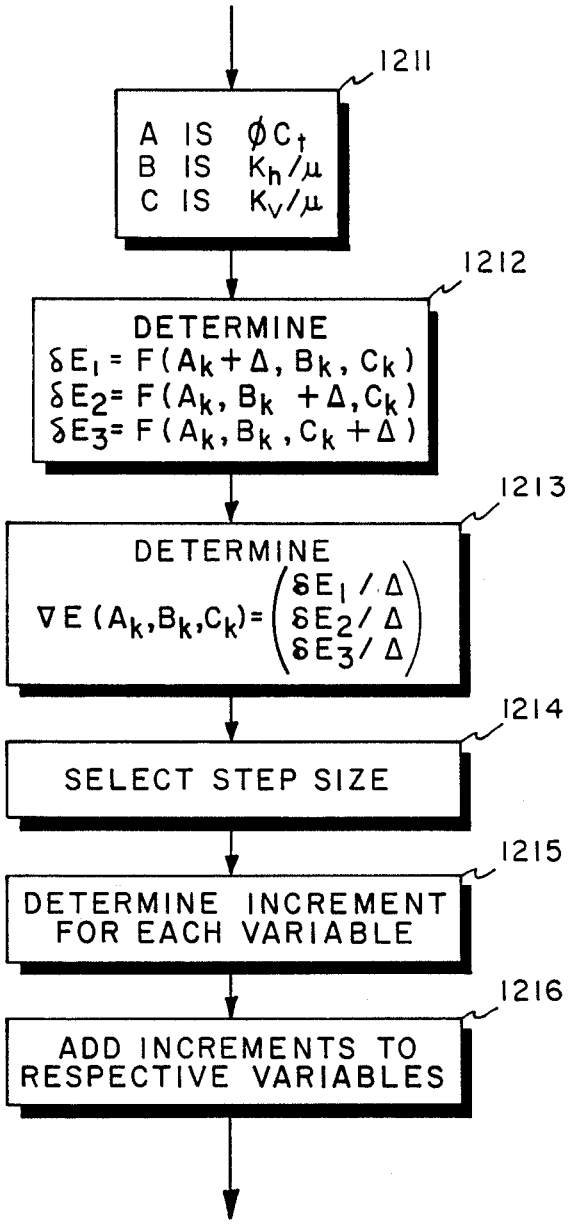
FIG. 12 is a flow diagram of the routine for obtaining revised values of the hydraulic parameters so as to reduce the error.

In the example of the minimization routine as shown in FIG. 12, the variables to be modified are designated as A, B, and C, so that, in the example of the embodiment hereof, A is $\phi c_t$, B is $k_h/\mu$, and C is $k_v/\mu$ (as shown in block 1211). The error function is defined by equation (24), and is seen to be a function, inter alia, of the computed pressures at the source probe, and the horizontal and vertical observation probes. As previously described, these computed pressures are, in turn, a function of the variables which are represented in FIG. 12 as A, B, and C. For a given set of error values, $A_k$, $B_k$, and $C_k$, one can obtain the partial derivative of E with respect to each variable, as:

$$\delta E_1 = F(A_k + \Delta, B_k, C_k)$$

$$\delta E_2 = F(A_k, B_k + \Delta, C_k)$$

$$\delta E_3 = F(A_k, B_k, C_k + \Delta)$$

and these computations are represented by the block 1212. The gradient of E can then be represented as $$\nabla E(A_k, B_k, C_k) = \begin{pmatrix} \delta E_1/\Delta \\ \delta E_2/\Delta \\ \delta E_3/\Delta \end{pmatrix}$$

as set forth in block 1213 in FIG. 12. The negative of the gradient defines an optimum direction, in variable space, in which to vary A, B, and C from their present values of $A_k$, $B_k$, and $C_k$. The block 1214 is then entered, this block representing the selection of the step size to be taken in the direction defined by the gradient. Reference can again be made to the above-cited book and patent with regard to step size determination. For each variable, the increment is then obtained by multiplying the step size by the component of the gradient in the direction of the particular variable, this function being represented by block 1215 in FIG. 12. With the increment added to each variable (block 1216) for this step, of the routine, the block 713 (FIG. 7) can be reentered for the next determination of computed pressure values. It will be understood that traversals of the loop 725 (FIG. 7) may also be involved during part of the procedure for determining the increments, such as during step size determination.

The principles of the invention are also applicable for use in conjunction with devices having different numbers of probes than in the illustrated embodiment, for example a source probe and a single observation probe, which may be spaced from or an identity with the source probe. In such cases, the hydraulic characteristics to be determined and the degrees of freedom thereof will be related to the number of available measurements. For example, assume that a source probe and a spaced vertical observation probe are utilized. In such case, one suitable selection of hydraulic properties would be to select trial values of $\eta_v$ and $\phi c_T a$, where a is the hydraulic anisotropy and equals $k_h/k_v$ or $\eta_h/\eta_v$. Measured and computed pressure, as a function of time, can then be employed to obtain output values of $\eta_v$ and $\phi c_T a$ using the techniques as set forth herein.

It will be understood that the techniques of the invention can be utilized in other ways. For example, the advantageous technique disclosed in conjunction with FIGS. 9 and 10 can be used to facilitate the obtainment of computed pressure response curves based on different trial values of hydraulic properties. Then, the computed responses for different trial values can then be compared to the measured response to see which trial values produced the closest match. This can be done, for example, by looking at machine-generated curves or by using machine-generated error calculations as described in conjuntion with FIG. 11.

I claim:

1. A method for determining a hydraulic property of formations surrounding a borehole, comprising the steps of:

establishing a transient pressure change in the formations surrounding the borehole;

measuring formation pressure responses at two spaced observation probe locations as a function of time;

selecting a trial value of the hydraulic property of the formations;

deriving computed formation pressure responses as a function of time at said observation probe locations using said trial value of the hydraulic property;

determining the error between the computed formation pressure responses and the measured formation pressure responses;

modifying the trial value of said hydraulic property; and repeating said deriving, determining, and modifying steps to reduce the error, the ultimately modified trial value representing the determined value of the hydraulic property.

2. The method as defined by claim 1, wherein said hydraulic property is permeability or diffusivity.

3. The method as defined by claim 2, wherein said step of establishing a pressure change comprises withdrawing fluid from the formations at a source probe location in the borehole wall at a pressure which is maintained substantially constant during most of the withdrawal time.

4. The method as defined by claim 2, wherein said step of modifying the trial value comprises modifying said value as a function of the determined error.

5. The method as defined by claim 2, wherein said deriving of computed formation pressure responses includes:

representing fluid flow from said formations during the established pressure change as a series of fluid flow pulses, the durations of said pulses decreasing for later-occurring pulses; and determining the computed formation pressure responses at a particular time as a summation of responses to individual ones of said fluid flow pulses.

6. The method as defined by claim 1, wherein said step of establishing a pressure change comprises withdrawing fluid from the formations at a source probe location in the borehole wall at a pressure which is maintained substantially constant during most of the withdrawal time.

7. The method as defined by claim 6 wherein said step of measuring formation pressure response further includes measuring pressure at the source probe location.

8. The method as defined by claim 6, wherein said step of modifying the trial value comprises modifying said value as a function of the determined error.

9. The method as defined by claim 6, wherein said deriving of computed formation pressure responses includes:

representing fluid flow from said formations during the established pressure change as a series of fluid flow pulses, the durations of said pulses decreasing for later-occurring pulses; and determining the computed formation pressure response at a particular time as a summation of responses to individual ones of said fluid flow pulses.

10. The method as defined by claim 9 wherein trial values are selected for $k_h/u$, $k_v/u$, and $\phi c_t$, where $k_h$ and $k_v$ are respectively the horizontal and vertical permeability of the formations, u is the viscosity of the formation fluid, $\phi$ is the porosity of the formations, and $c_t$ is the compressibility of the formation fluid.

11. The method as defined by claim 6 wherein trial values are selected for $k_h/u$, $k_v/u$, and $\phi c_t$, where $k_h$ and kv are respectively the horizontal and vertical permeability of the formations, u is the viscosity of the formation fluid, $\phi$ is the porosity of the formations, and $c_t$ is the compressibility of the formation fluid.

12. The method as defined by claim 1, wherein said step of modifying the trial value comprises modifying said value as a function of the determined error.

13. The method as defined by claim 1, wherein said deriving of computed formation pressure responses includes:

representing fluid flow from said formations during the established pressure change as a series of fluid flow pulses, the durations of said pulses decreasing for later-occurring pulses; and determining the computed formation pressure responses at a particular time as a summation of responses to individual ones of said fluid flow pulses.

14. The method as defined by claim 1 wherein said step of selecting a trial value of a hydraulic property comprises selecting trial values of a plurality of hydraulic properties of the formations.

15. The method as defined by claim 1 wherein said hydraulic properties include the vertical and horizontal permeability of the formations.

16. The method as defined by claim 1 wherein said hydraulic properties further include the viscosity and compressibility of the formation fluid, and the formation porosity.

17. The method as defined by claim 1 wherein trial values are selected for $k_h/u$, $k_v/u$, and $\phi c_t$, where $k_h$ and $k_v$ are respectively the horizontal and vertical permeability of the formations, u is the viscosity of the formation fluid, $\phi$ is the porosity of the formations, and $c_t$ is the compressibility of the formation fluid.

18. The method as defined by claim 1 wherein said hydraulic properties include the vertical and horizontal diffusivity of the formations.

19. Apparatus for determining a hydraulic property of formations surrounding a borehole, comprising:

a logging device moveable through the borehole, said logging device including a source probe and at least one observation probe, said source and observation probes being adapted for contact with the borehole wall;

means for withdrawing fluid from said formations at said source probe;

means for measuring formation pressure response at said source probe and said observation probe as a function of time;

means for selecting a trial value of said hydraulic property of formations;

means for deriving a computed formation pressure response, as a function of time, at said source and observation probes, using said trial value of the hydraulic property;

means for determining the error between the computed formation pressure response at said source and observation probes and the measured formation pressure response at said source and observation probes;

means for modifying the trial value of said hydraulic property; and means for controlling repetitive operation of said selecting means, deriving means, determining means and modifying means to reduce said error, the ultimately modified trial value representing the determined value of the hydraulic property.

20. Apparatus as defined by claim 19, wherein said hydraulic property is permeability or diffusivity.

21. Apparatus as defined by claim 20, wherein said means for withdrawing fluid from said formations comprises means for withdrawing fluid from said formations at a pressure which is maintained substantially constant during most of the withdrawal time.

22. Apparatus as defined by claim 21, wherein said means for deriving of a computed formation pressure response includes:

means for representing fluid flow from said formations during said fluid withdrawal as a series of fluid flow pulses, the durations of said pulses decreasing for later-occurring pulses; and means for determining the computed formation pressure response at a particular time as a summation of responses to individual ones of said fluid flow pulses.

23. Apparatus as defined by claim 19, wherein said means for withdrawing fluid from said formations comprises means for withdrawing fluid from said formations at a pressure which is maintained substantially constant during most of the withdrawal time.

24. Apparatus as defined by claim 23, wherein said means for deriving of a computed formation pressure response includes:

means for representing fluid flow from said formations during said fluid withdrawal as a series of fluid flow pulses, the durations of said pulses decreasing for later-occurring pulses; and means for determining the computed formation pressure response at a particular time as a summation of responses to individual ones of said fluid flow pulses.

25. Apparatus as defined by claim 19, wherein said means for modifying the trial value comprises means for modifying said value as a function of the determined error.

26. Apparatus as defined by claim 19, wherein said means for deriving of a computed formation pressure response includes:

means for representing fluid flow from said formations during said fluid withdrawal as a series of fluid flow pulses, the durations of said pulses decreasing for later-occurring pulses; and means for determining the computed formation pressure response at a particular time as a summation of responses to individual ones of said fluid flow pulses.

27. Apparatus as defined by claim 26, further comprising means for measuring the rate of fluid flow at said source probe, and wherein said means for deriving a computed formation response is responsive to the measured fluid flow.

28. Apparatus as defined by claim 19, further comprising means for measuring the rate of fluid flow at said source probe, and wherein said means for deriving a computed formation response is responsive to the measured fluid flow.

29. Apparatus for determining the vertical and horizontal permeability of formations surrounding a borehole, comprising:

a logging device moveable through the borehole, said logging device inclucing a source probe, a horizontal observation probe and a vertical observation probe, said source and observation probes being adapted for contact with the borehole wall;

means for withdrawing fluid from said formations at said source probe at a pressure which is maintained substantially constant during most of the withdrawal time;

means for measuring formation pressure response at said source probe and said observation probes as a function of time;

means for selecting trial values of the vertical and horizontal permeability of the formations;

means for deriving a computed formation pressure response, as a function of time, at said source probe and observation probes, using said trial values of vertical and horizontal permeability;

means for determining the error between the computed formation pressure response at said source probe and observation probes and the measured formation pressure response at said source probe and observation probes;

means for modifying the trial values of vertical and horizontal permeability; and means for controlling repetitive operation of said deriving means, said determining means and said modifying means to reduce said error, the ultimately modified trial values representing the determined values of vertical and horizontal permeability.

30. Apparatus as defined by claim 29, wherein said means for modifying the trial values of vertical and horizontal permeability comprises means for modifying said values as a function of the determined error.

31. Apparatus as defined by claim 29, wherein said means for deriving of a computed formation pressure response includes:

means for representing fluid flow from said formations during said fluid withdrawal as a series of fluid flow pulses, the durations of said pulses decreasing for later-occurring pulses; and means for determining the computed formation pressure response at a particular time as a summation of responses to individual ones of said fluid flow pulses.

32. Apparatus as defined by claim 31, further comprising means for measuring the rate of fluid flow at said source probe, and wherein said means for deriving a computed formation response is responsive to the measured fluid flow.

33. Appararus as defined by claim 29, further comprising means for measuring the rate of fluid flow at said source probe, and wherein said means for deriving a computed formation response is responsive to the measured fluid flow.

34. A method for determining a hydraulic property of formations surrounding a borehole, comprising the steps of:

establishing a transient pressure change in the formations surrounding the borehole;

measuring the formation pressure response as a function of time;

selecting trial values of the hydraulic property of the formations;

deriving computed formation responses as a function of time using the trial values of said hydraulic property, the computed formation responses being obtained by: representing fluid flow from the formations during the established pressure change as a series of fluid flow pulses, the durations of said pulses decreasing for later-occurring pulses, and determining the computed formation pressure response at a particular time as a summation of responses to individual ones of said fluid flow-pulses;

comparing the measured and derived formation responses to obtain the trial value that produces the best match.

35. The method as defined by claim 34, wherein said hydraulic property is permeability or diffusivity.

36. The method as defined by claim 34, wherein said step of measuring formation pressure response includes measuring pressure at a source probe location in the borehole wall and a two spaced observation probe locations in the borehole wall.

37. The method as defined by claim 36 wherein said step of selecting trial values of a hydraulic property comprises selecting trial values of a plurality of hydraulic properties of the formations.

38. The method as defined by claim 37 wherein said hydraulic properties include the vertical and horizontal permeability of the formations.

39. The method as defined by claim 37 wherein said hydraulic properties further include the viscosity and compressibility of the formation fluid, and the formation porosity.

40. The method as defined by claim 37, wherein trial values are selected for $k_h/u$, $k_v/u$, and $\phi c_t$, where $k_h$ and $k_v$ are respectively the horizontal and vertical permeability of the formations, u is the viscosity of the formation fluid, $\phi$ is the porosity of the formations, and $c_t$ is the compressibility of the formation fluid.

* * * * *